US005551337A

United States Patent [19]

Miki et al.

[11] Patent Number: 5,551,337

[45] Date of Patent: Sep. 3, 1996

[54] METHOD AND APPARATUS FOR DETECTING A TYPE OF STENCIL AND CONTROLLING THERMAL PERFORATION ENERGY THEREBY

[75] Inventors: Takashi Miki, Toyoake; Takashi Okumura, Nagoya, both of Japan

[73] Assignee: Brother Kogyo Kabushiki Kaisha, Nagoya, Japan

[21] Appl. No.: 315,497

[22] Filed: Sep. 30, 1994

[30] Foreign Application Priority Data

Oct. 28, 1993 [JP] Japan ..... 5-270205

[51] Int. Cl.[6] ..... B41C 1/055; B41C 1/14

[52] U.S. Cl. ..... 101/128.4; 101/125; 101/DIG. 46; 347/193; 400/120.13

[58] Field of Search ..... 101/116, 125, 101/128.21, 128.4, 129, 127, DIG. 46; 400/120.13; 347/193

[56] References Cited

U.S. PATENT DOCUMENTS

| | | | |
|---|---|---|---|
| 5,085,529 | 2/1992 | McGourty et al. | 400/120.13 |
| 5,195,832 | 3/1993 | Fujikawa et al. | 101/128.21 |
| 5,220,352 | 6/1993 | Yamamoto et al. | 347/215 |
| 5,384,585 | 1/1995 | Okumura | 101/128.4 |

FOREIGN PATENT DOCUMENTS

| | | | |
|---|---|---|---|
| 0512804 | 11/1992 | European Pat. Off. . | |
| 0589710 | 3/1994 | European Pat. Off. . | |
| 0607699 | 7/1994 | European Pat. Off. . | |
| 61-72590 | 4/1986 | Japan . | |
| 273984 | 12/1986 | Japan | 101/116 |
| 153196 | 6/1988 | Japan | 101/128.4 |
| 237970 | 10/1988 | Japan | 347/193 |
| 209162 | 8/1989 | Japan | 347/193 |
| 57357 | 2/1990 | Japan | 101/128.4 |
| 115961 | 4/1992 | Japan | 347/193 |
| 336278 | 11/1992 | Japan | 101/125 |
| 338559 | 11/1992 | Japan | 347/193 |
| 42709 | 2/1993 | Japan | 347/193 |
| 143780 | 5/1994 | Japan | 101/128.4 |

*Primary Examiner*—Stephen Funk
*Attorney, Agent, or Firm*—Oliff & Berridge

[57] ABSTRACT

A plate making device and method, wherein when a light sensor detects that the stencil plate inserted into the plate making device is provided with the through hole, the controller supplies a current to the thermal head for T1 seconds to control the heat time to be short, so that the perforation energy of the thermal head is reduced. On the other hand, when the light sensor detects that the stencil plate has no through hole, the controller supplies a current to the thermal head for T2 seconds longer than T1 seconds to control the heat time to be long, so that the perforation energy of the thermal head is increased. In this device, even when any type of stencil plate is used, the plate making process providing the best print quality for each stencil plate can be performed.

33 Claims, 12 Drawing Sheets

Fig.12

| | | |
|---|---|---|
| INK DRYNESS | HIGH | LOW |
| INK VISCOSITY | LOW | HIGH |
| INK BLURRING | LARGE | SMALL |
| INK-IMPREGNATED MEMBER | HARD | SOFT |
| EASINESS OF PERFORATION | EXCELLENT | BAD |
| SENSITIVITY OF STENCIL PAPER | BAD | EXCELLENT |
| PERFORATION ENERGY | SMALL | LARGE |

METHOD AND APPARATUS FOR DETECTING A TYPE OF STENCIL AND CONTROLLING THERMAL PERFORATION ENERGY THEREBY

BACKGROUND OF THE INVENTION

1. Field of the Invention

The present invention relates to a plate making device and method, and particularly to a plate making device and method for forming a perforation image on a stencil plate with heat-perforating means.

2. Description of Related Art

A stencil plate as disclosed in Japanese Unexamined Patent Publication No. 61-72590 has been hitherto known as an ink-containing stencil plate used for a stamp device for stencil printing. The stencil plate as described above will be described with reference to FIGS. 10A and 10B.

As shown in FIGS. 10A and 10B, the stencil plate 50 comprises a heat sensitive stencil paper 54 formed of a thermoplastic film 51 and a porous supporting member 53, non-woven cloth 56 serving as an ink-impregnated member, a frame 57 disposed so as to surround the non-woven cloth 56, and a film 58 serving as an ink-impermeable base member, all of which are successively laminated. Adhesive agents 59 are provided between the heat sensitive stencil paper 54 and the frame 57. Adhesive agents 52 are provided between the thermoplastic film 51 and the porous supporting member 53.

A perforation image is formed on the thus-constructed stencil plate 50 by heat-melting the thermoplastic film 51 of the heat sensitive stencil paper 54 with a stamp device using a thermal head, for example (see reference numeral 1 in FIG. 2) (formation of a perforation image is hereinafter referred to as "plate making"). The plate-made stencil plate 50 is installed into a stamp member 60 shown in FIG. 11(see FIG. 2), and stencil printing is performed by pushing the stamp member 60 against a print sheet 70. The stamp member 60 includes a grip 61, a cushion layer 62, and an adhesive layer 63.

Through experiment, it has been determined that the ink used for the stencil plate 50 as described above has characteristics as shown in FIG. 12. That is, in order to enable the printed ink to dry rapidly, the viscosity of the ink should be reduced. However, in this case, the ink is liable to be blurred, and thus, print quality is lowered. When the ink viscosity is low, ink flow is improved for a harder ink-impregnated member, and thus, the print quality is improved.

When the ink-impregnated member is hard, there is good contact between the thermal head and the stencil paper in a plate-making process for the stencil paper, and thus, heat energy of the thermal head is easily transferred to the stencil paper so that a perforation image is easily formed. In this case, if the stencil paper has high sensitivity to perforation, perforated holes would be large. Therefore, the perforation sensitivity of the stencil paper must be lowered or energy to be applied to the thermal head must be reduced.

Further, in order to improve the print quality without concern of ink dryness, that is, using ink having low dryness, the ink viscosity must be increased, the ink-impregnated member must be soft, the stencil paper sensitivity must be improved and the energy to be applied to the thermal head must be increased.

As described above, various characteristic combinations may be proposed among the stencil paper, the ink and the ink-impregnated member that are used for the stencil printing. However, when the energy to be applied to the thermal head is constant, there occur problems in that in some cases, sufficient perforation cannot be performed in accordance with the type of the stencil plate, and the perforated holes can be excessively large.

SUMMARY OF THE INVENTION

An object of the present invention is to provide a plate making device and method wherein even when various kinds of stencil plates are used, a plate making process providing high print quality for each stencil plate can be performed.

In order to attain the above object, the plate making device according to this invention includes heat-perforating structure for thermally perforating a heat sensitive stencil paper of a stencil plate according to a desired image, a detector for detecting a type of stencil plate and a controller for controlling perforation energy of the heat-perforating structure in accordance with an identification result of an identifying device. In the plate making device according to the invention thus constructed, the detector detects the type of stencil plate. On the basis of this detection, the controller controls perforation energy of the heat-perforating structure. Through this operation, the plate making process can be optimized irrespective of the type of stencil plate. Therefore, when any kind of stencil plate is inserted into the device, the optimum plate making process is performed, and the highest quality printing can be performed.

BRIEF DESCRIPTION OF THE DRAWINGS

Preferred embodiments of the present invention will be described in detail with reference to the following figures wherein:

FIG. 12 is a table showing ink characteristics and print quality features.

DETAILED DESCRIPTION OF PREFERRED EMBODIMENTS

Preferred embodiments according to this invention will be described with reference to the accompanying drawings.

Figure 1A:
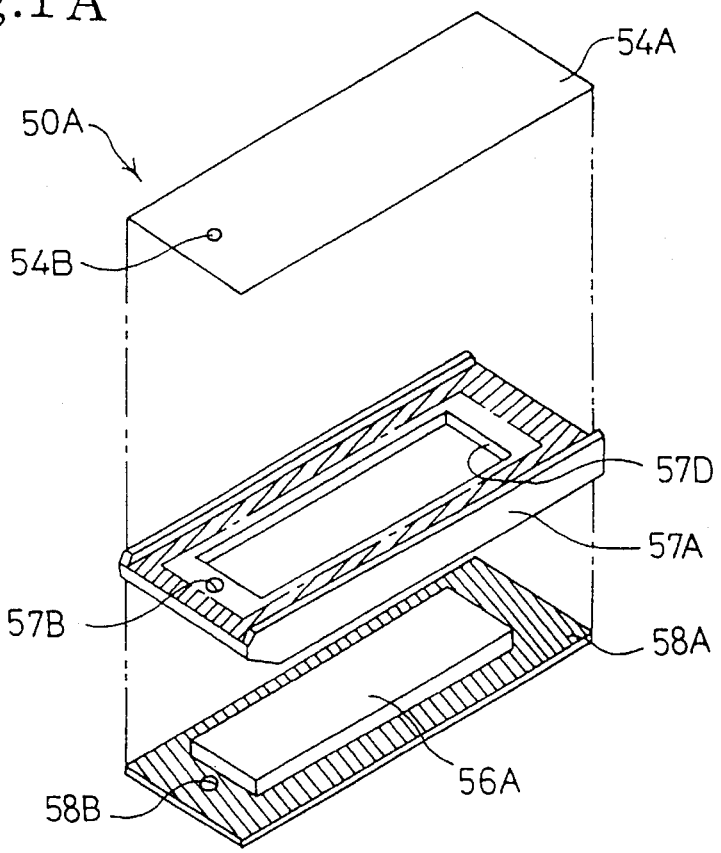
FIG. 1A shows an exploded perspective view of the stencil plate.
Figure 1B:
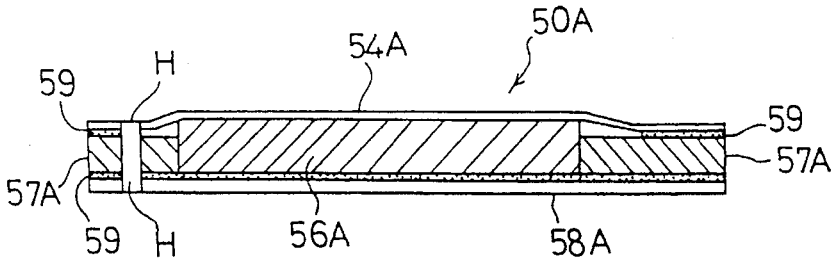
FIG. 1B is a cross-sectional view of the stencil plate having a hole.
Figure 1C:
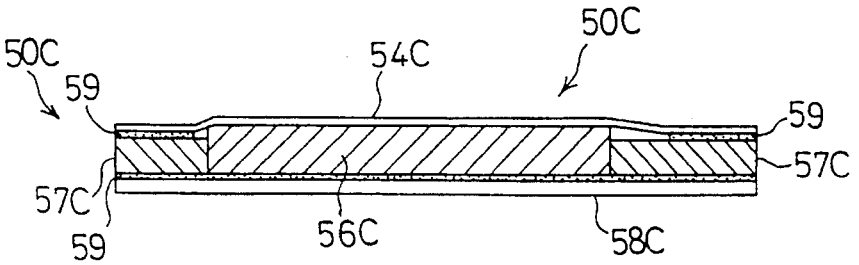
FIG. 1C is a cross-sectional view of the stencil plate having no hole.
Figure 2:
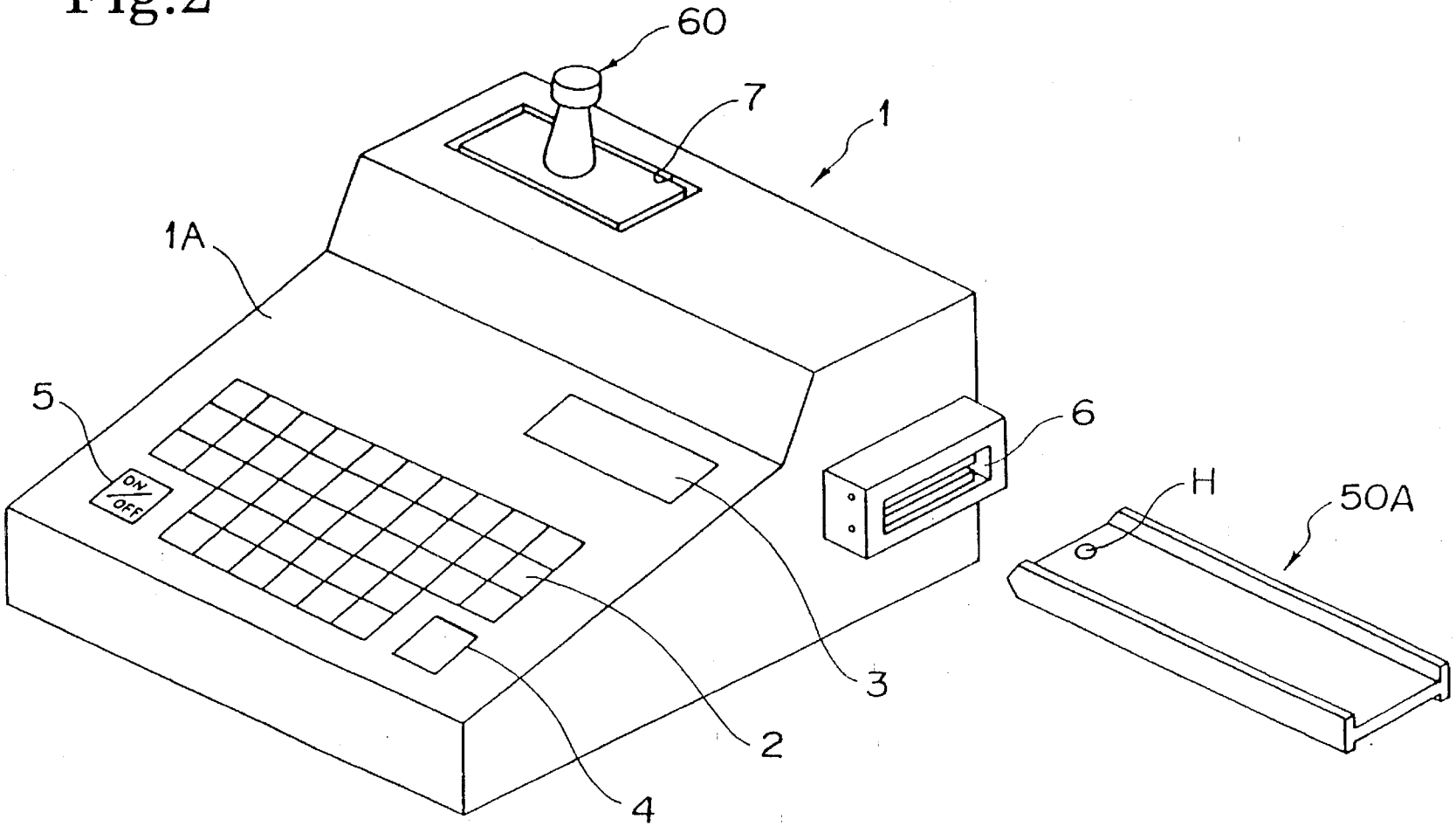
FIG. 2 is a perspective view of the plate making device and the stencil plate.
Figure 3:
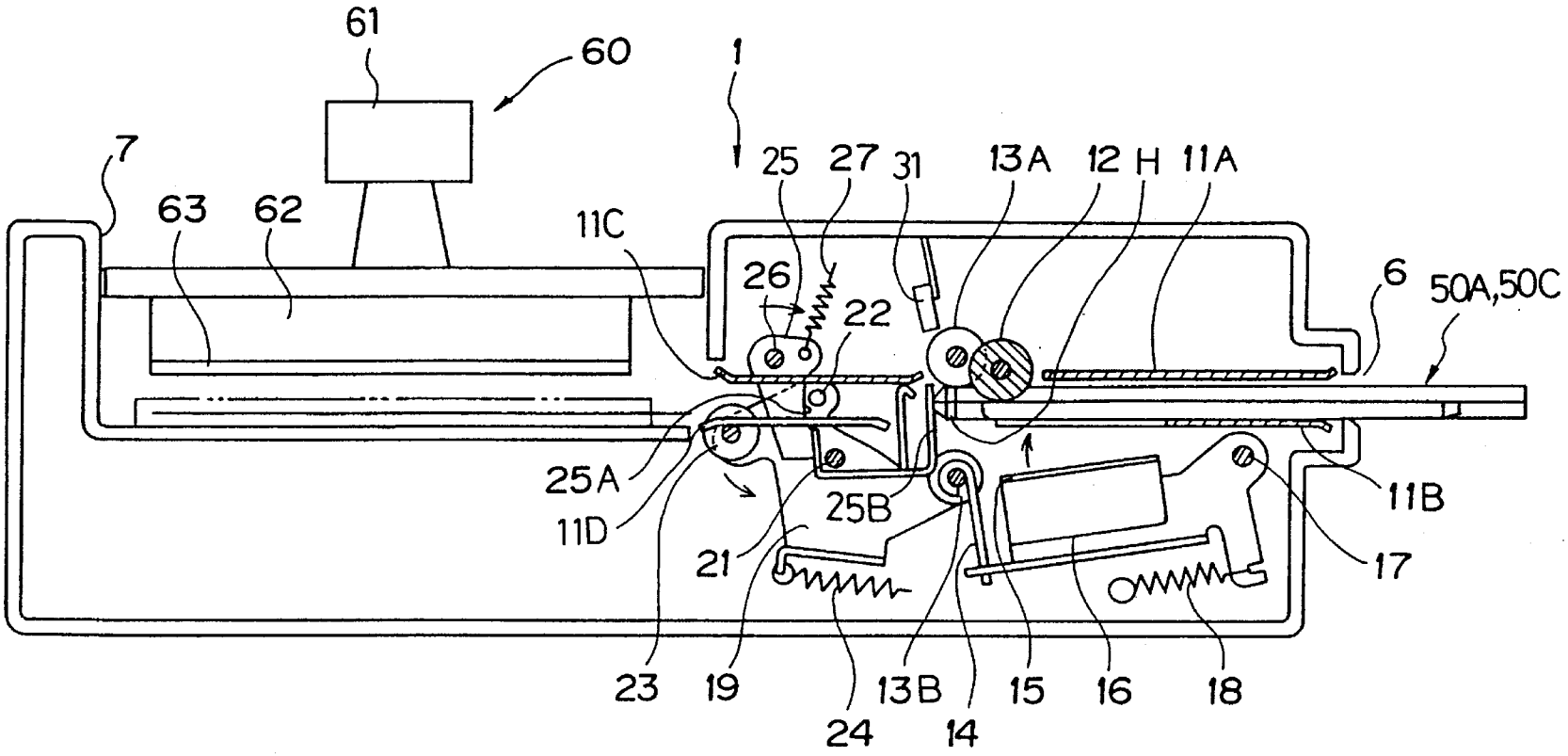
FIG. 3 is a cross-sectional view of the plate making device shown in FIG. 2 prior to operation.
Figure 4:
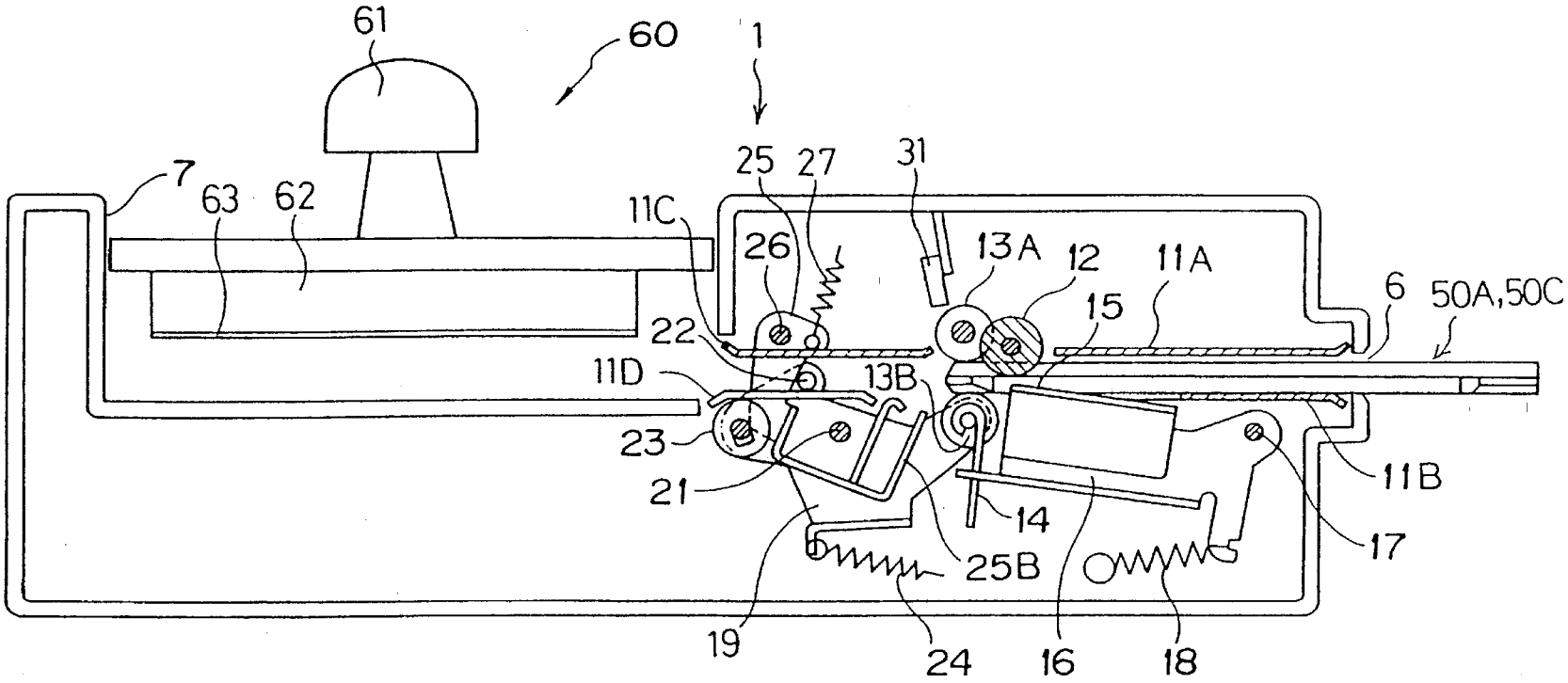
FIG. 4 is a cross sectional view of the plate making device shown in FIG. 2 making a stencil plate during operation.
Figure 5:
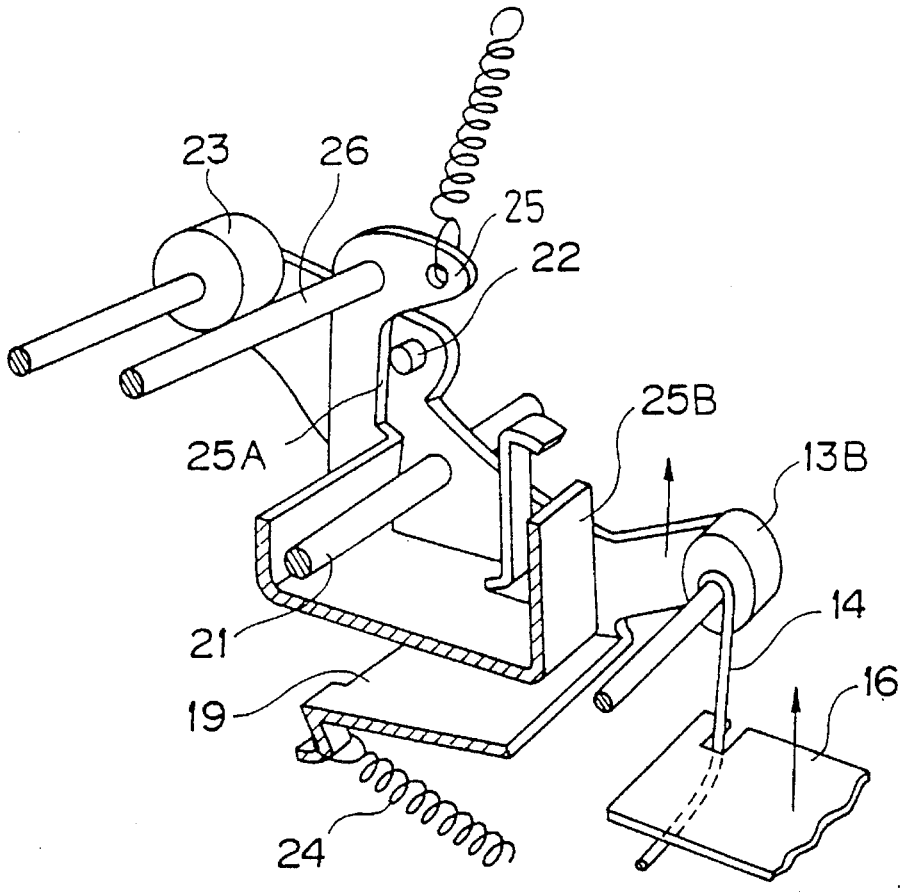
FIG. 5 is a partially perspective view of the plate making device.
Figure 7A:
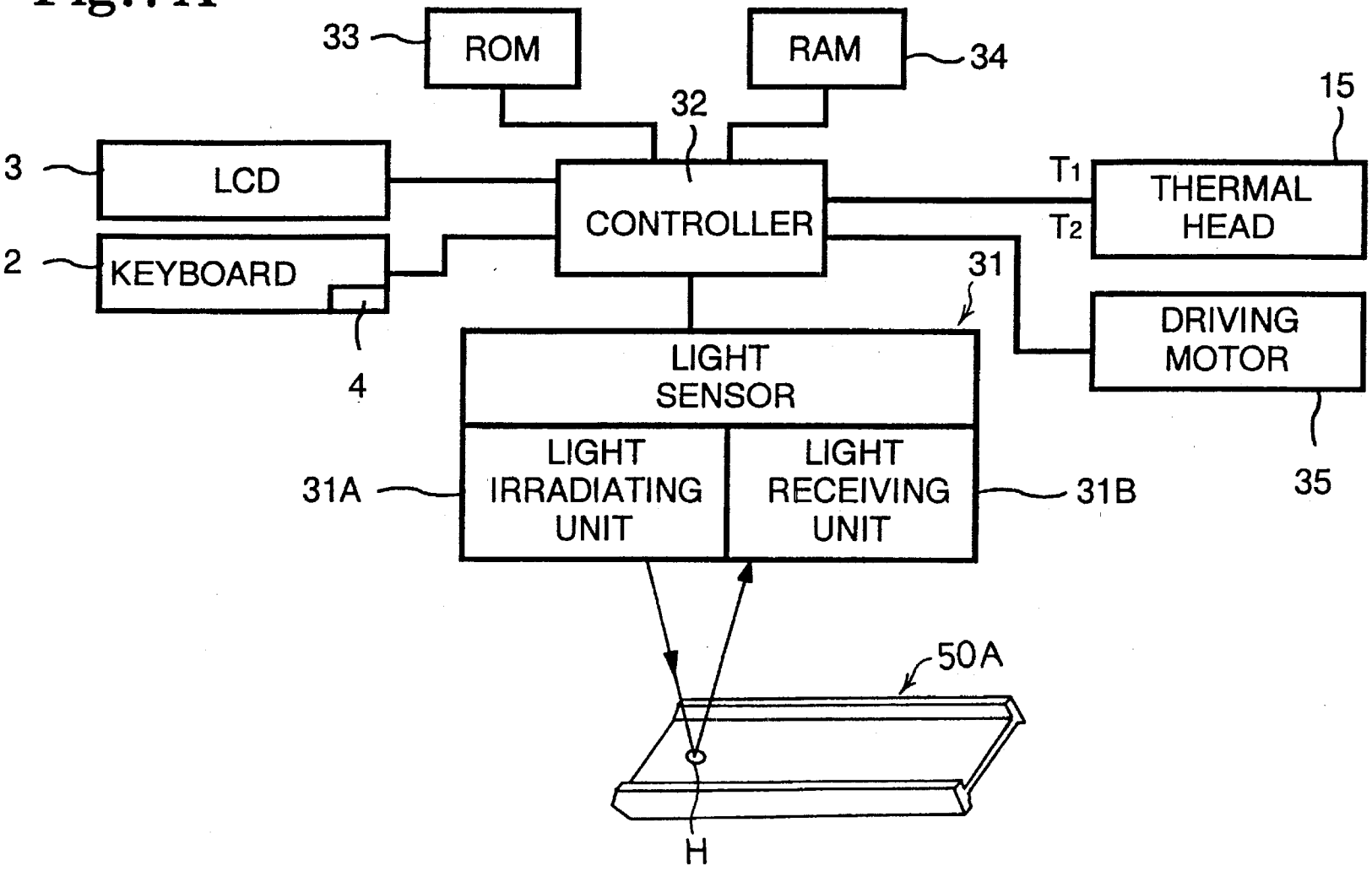
FIG. 7A is a block diagram of a control system of the plate making device.
Figure 7B:
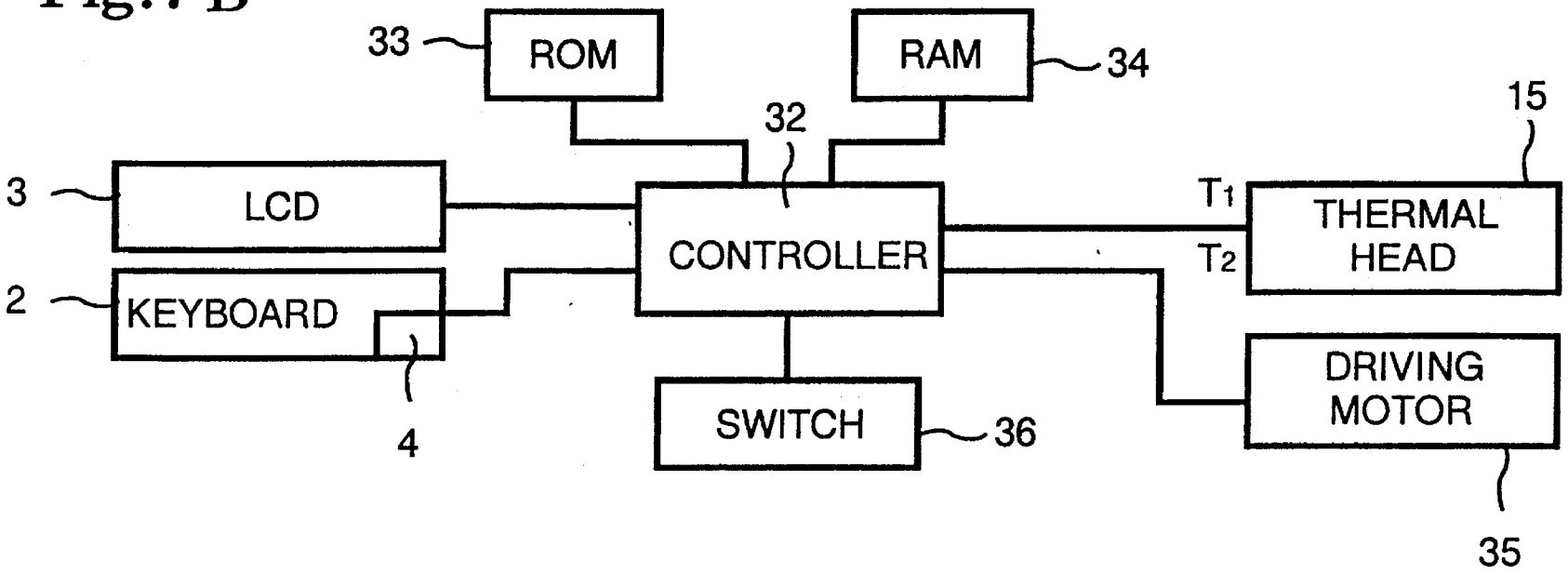
FIG. 7B is a block diagram of a control system using a mechanical switch.

FIGS. 1A, 1B and 1C are an exploded perspective view and sectional views of stencil plates 50A and 50C. FIG. 2 is a perspective view of a plate making device 1, and FIGS. 3, 4 and 5 are a side sectional view and partial perspective views of the plate making device 1. FIGS. 7A and 7B are block diagrams showing a control system for the plate making device.

First, the stencil plates 50A and 50C will be described.

As shown in FIGS. 1A and 1B, a hole 58B is formed at the center of the left end portion of a film 58A that is designed in a rectangular shape. A non-woven cloth 56A impregnated with ink is disposed at the center position of the film 58A. A rectangular hole 57D is formed at the central portion of a frame 57A so that the rectangular hole 57D surrounds the non-woven cloth 56A when the film 58A and the frame 57A are overlapped with each other. A hole 57B is formed at the center of the left end portion of the frame 57A. A hole 54B is formed at the center of the left end portion of a heat sensitive stencil paper 54A. The outline dimensions of the film 58A and the heat sensitive stencil paper 54A are equal to that of the frame 57A.

The film 58A, the non-woven cloth 56A, the frame 57A and the heat sensitive stencil paper 54A are overlapped with one another at a prescribed position and are mutually adhesively attached to one another, thereby forming a stencil plate 50A. At this time, the holes 58B, 57B and 54B are aligned with one another, thereby forming a through hole H (see FIG. 1B).

As shown in FIG. 1C, a frame that has the same shape as the frame 57A, but has no hole 57B is provided as frame 57C. Likewise, a film that has the same shape as the film 58A, but has no hole 58B is provided as film 58C, and a heat sensitive stencil paper that has the same shape as the heat sensitive stencil paper 54A, but has no hole 54B is provided as heat sensitive stencil paper 54C. At the center position of the film 58C is disposed non-woven cloth 56C impregnated with ink that is different from the ink impregnated in the non-woven cloth 56A.

Like the stencil plate 50A, the film 58C, the non-woven cloth 56C, the frame 57C and the heat sensitive stencil paper 54C are overlapped with one another at a prescribed position and are mutually adhesively attached to one another to form a stencil plate 50C. The stencil plate 50C has no through hole H. The type of stencil plate 50 is determined on the basis of the presence or absence of the through hole H.

In this embodiment, the ink that is impregnated in the non-woven cloth 56A of the stencil plate 50A is a high-dryness ink, which is rapidly dried. On the other hand, the ink that is impregnated in the non-woven cloth 56C is a low-dryness ink, which is slowly dried, but with which printed characters are not easily blurred. Accordingly, as is apparent from the table of FIG. 12, the stencil plate 50A requires small perforation energy, and the stencil plate 50C requires large perforation energy. The non-woven clothes 56A and 56C constitute the ink-impregnated member of this invention.

A polyethylene terephthalate film having a thickness of 2 μm (hereinafter referred to as "PET") is suitably used for the thermoplastic film 51 of the heat sensitive stencil paper 54A and the heat sensitive stencil paper 54C, or a film of polypropylene, vinylidene chloride-vinyl chloride copolymer or the like may be used. The thickness of PET is preferably set between about 1 μm and 4 μm. This is because PETs having a thickness of 1 μm or less have low strength, and it is impossible to perforate PETs having a thickness of 4 μm or more using a generally-used thermal head of about 50 $mJ/mm^2$.

Figure 10A:
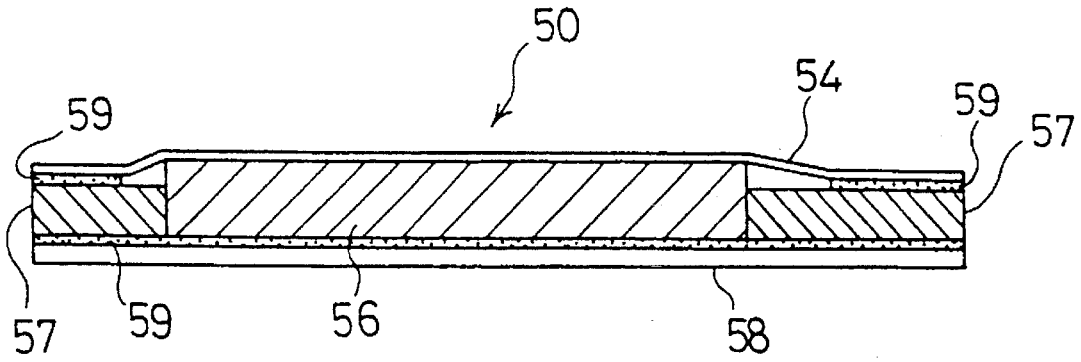
Fig.10A PRIOR ART
FIG. 10A is a cross-sectional view of a conventional stencil plate.
Figure 10B:
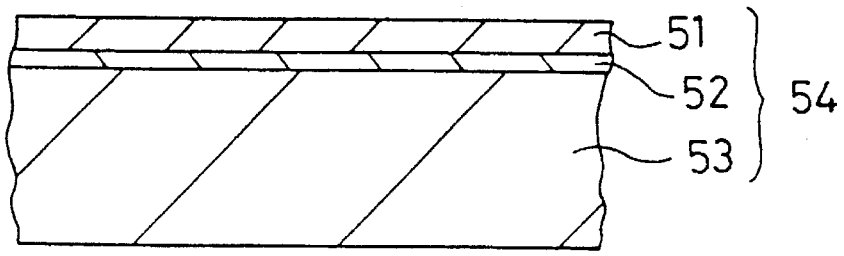
Fig.10B PRIOR ART
FIG. 10B is a partially enlarged cross-sectional view of the conventional stencil plate.

The porous supporting member 53 (see FIG. 10B) constituting part of the heat sensitive stencil paper 54 is suitably a natural fiber such as Manila hemp, paper mulberry (Broussonetia kazinoki), mitzumata (Edgeworthia papyrifera) or the like, a synthetic resin such as polyethylene terephthalate, polyvinyl alcohol, polyacrylonitrile or the like, or porous thin paper mainly containing semisynthetic fiber such as rayon.

Further, since the ink is impregnated in the non-woven clothes 56A and 56C, the material for the frames 57A and 57C surrounding the non-woven clothes 56A and 56C is suitably vinyl chloride, polypropylene, polyethylene, polyacetal or the like into which no ink is impregnated.

The films 58A and the 58C are ink-impermeable base members. An adhesive layer is coated on the upper surface (oblique-line portion in FIG. 1) of each film, and both of the frame 57A and the non-woven cloth 56A (both of the frame 57C and the non-woven cloth 56C) are adhesively attached onto the adhesive layer. The material for the films 58A and 58C is suitably a resin film such as vinyl chloride, polypropylene, polyethylene terephthalate or the like, into which no ink is impregnated.

Next, the construction of the plate making device 1 will be described.

Figure 11:
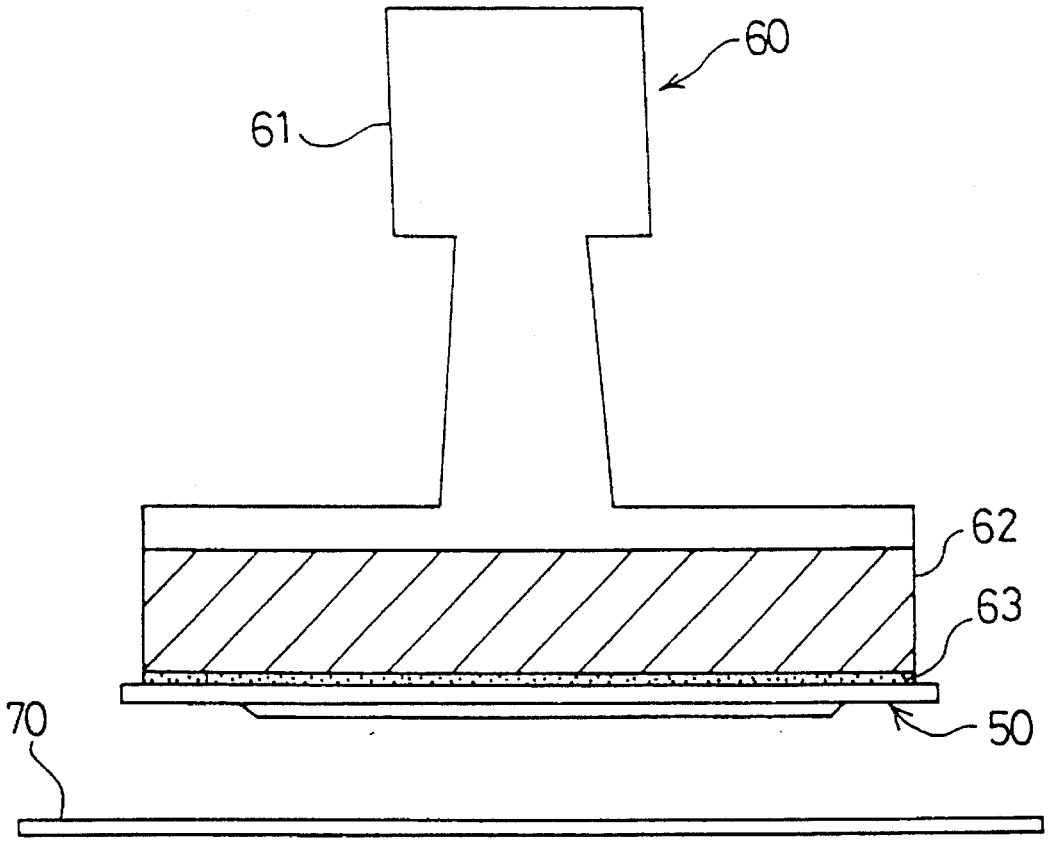
Fig.11 PRIOR ART
FIG. 11 is a side view of a conventional stamp member.

As shown in FIG. 2, the plate making device 1 has an operation unit 1A at the front side of the top face of the plate making device 1. On the operation unit 1A, a keyboard 2 is provided for inputting a desired perforation image, a display 3 formed of liquid crystal is provided for displaying the input perforation image, a plate-making switch 4 is provided for indicating the start of a plate making process, and an on/off switch 5 is provided for switching a power source on and off. At the right side surface of the plate making device 1 is provided an insertion window 6 through which the stencil plate 50A or 50C is inserted, and on the upper surface at the rear side of the plate making device 1 is provided a stamp groove 7 through which a stamp member 60 (see FIG. 11) is inserted.

Figure 6:
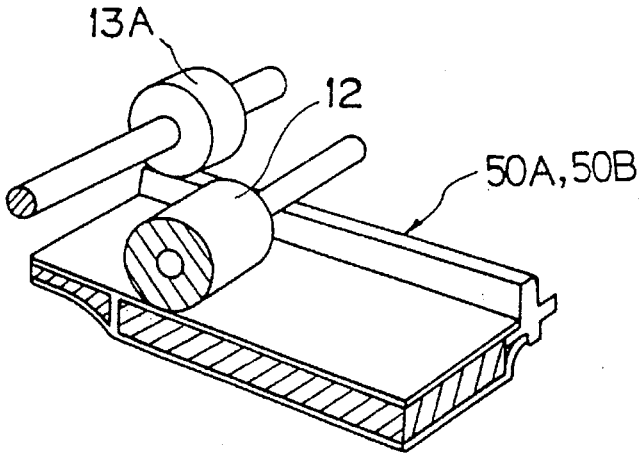
FIG. 6 is a partially perspective view of the plate making device.

In the inner construction of the plate making device, as shown in FIG. 3, first and second feeding guides 11A and 11B at upper and lower sides, respectively that guide the stencil plate 50A or 50C are disposed inside of the insertion window 6. The stencil plate 50A or 50C is inserted into the insertion window 6 with the heat sensitive stencil papers 54A and 54C oriented facing downward. A platen 12 (see FIG. 6), which cooperates with a thermal head 15 as described later, is disposed at the lower feeding side of the first feeding guide 11A, and a pair of feeding rollers 13A and 13B for feeding the stencil plate 50A or 50C are provided in the vicinity and at the left side of the platen 12.

Feeding roller 13B is linked to a head holder 16 to which the thermal head 15 is secured through a link wire 14. The head holder 16 is rotated by a rotating device (not shown). The head holder 16 is rotatably secured to a shaft 17 that is fixed to the device at the upper portion of the right end of the head holder 16, and it is urged in a clockwise direction by a spring 18 at the lower side of the right end.

Feeding roller 13B is secured to the right-end portion of a roller holder 19, which is rotatably supported by the shaft 21 (see FIG. 5), and a pin 22 that is slidably contacted with the side end surface 25A of a paper gate 25 is fixed to the upper tip portion of the roller holder 19. A discharge roller 23 for discharging the stencil plate 50A or 50C to the stamp groove 7 is freely rotatably secured to the left end portion of the roller holder 19.

The paper gate 25 is freely rotatably secured to the shaft 26, and one end of a spring 27 is engaged with the right side of the paper gate 25 to urge the paper gate 25 in a counterclockwise direction.

With the above construction, upon rotation of the head holder 16 in the clockwise direction, the tip of the left end portion (heating portion) of the thermal head 15 is pressed against the heat sensitive stencil paper 54A or 54C by a predetermined pressing force. When the roller holder 19 is rotated counterclockwise around the shaft 21 against the force of a spring 24 in synchronism with the head holder 16 as described above, paper gate 25, and the paper gate 25 is rotated clockwise around the shaft 26. As a result, a gate portion 25B of the paper gate 25 is moved downwardly, and the stencil plate 50A or 50C is allowed to be fed toward the left (a lower feeding side).

A light sensor 31 having a light irradiating unit 31A and a light receiving unit 31B (see FIGS. 3 and 7A) is disposed above feeding roller 13A, and light emitted from the light irradiating unit 31A is irradiated to the through hole H of the stencil plate 50A.

Third and fourth feeding guides 11C and 11D are disposed extending from the first and second feeding guides 11A and 11B and at the left side of the feeding rollers 13A and 13B.

In FIG. 3, a stamp member 60 inserted in the stamp groove 7 is disposed at the left side of the third and fourth feeding guides 11C, 11D. The stamp member 60 comprises a grip 61, a cushion layer 62 formed at the lower end of the grip 61 and an adhesive layer 63 formed on the lower surface of the cushion layer 62. The stencil plate 50A or 50C, for which the plate making process is finished by the thermal head 15, is guided and fed to the lower side of the stamp member 60 by the third and fourth feeding guides 11C and 11D.

Next, a control system for the plate making device 1 will be described with reference to FIG. 7A.

As shown in FIG. 7A, the light sensor 31 is connected to a controller 32 comprising a CPU, etc., and the controller 32 is connected to a ROM 33 for storing a program for performing the operation of the plate making device 1, a RAM 34 for temporarily storing processed data, a thermal head 15, which is contacted with the heat sensitive stencil paper 54 of the stencil plate 50 and serves to perforate the heat sensitive stencil paper 54, and a driving motor 35 for driving the head holder 16 (see FIG. 3).

The controller 32 is connected to the keyboard 2, the plate making switch 4 and the liquid crystal display 3. The controller 32 displays on the liquid crystal display 3 a perforation image formed of characters, images, ruled lines, etc. that are input through the keyboard 2. By pushing down the plate making switch 4, the thermal head 15 and the driving motor 35 are driven to perforate the heat sensitive stencil paper 54, and a perforation image displayed on the liquid crystal display 3 is formed on the stencil plate 50A or 50C.

Next, an operation of inserting the stencil plate 50A, 50C into the plate making device 1 to form a desired perforation image will be described.

First, the on/off switch 5 is switched on to enable actuation of the plate making device 1. Thereafter, the stencil plate 50C is inserted into the insertion window 6 of the plate making device 1, and the device is configured as shown in FIG. 3 so that the tip portion of the stencil plate 50C abuts the gate portion 5B of the paper gate 25, and it is prevented from further advancing. At this time, as shown in FIG. 7A, light is irradiated from the light irradiating unit 31A of the light sensor 31 to the stencil plate 50C, reflected from the frame 57C and received by the light receiving unit 31B of the light sensor 31. A light reception signal is input from the light receiving unit 31B to the controller 32, and the controller 32 judges that the stencil plate 50C has no through hole H.

When the stencil plate 50A is inserted into the plate making device 1, the light is irradiated from the light irradiating unit 31A of the light sensor 31 to the through hole H of the stencil plate 50A; however, the light is not reflected from the frame 57, and thus, it does not reach the light receiving unit 31B of the light sensor 31. Therefore, the controller 32 determines that the printing plate is the stencil plate 50A. The judgment result in either case is stored into RAM 34.

When the stencil plate 50A or 50C is inserted, an operator inputs desired characters, images, ruled lines or the like through the keyboard 2 to form a perforation image. At this time, the input characters or the like are displayed on the display 3. The operator checks the displayed characters, etc., and if a desired perforation image is displayed, the operator pushes down the plate-making switch 4.

The plate-making process by the controller 32 is started in accordance with the pushing down of the plate-making switch 4. First, the head holder 16 is rotated clockwise, whereby the thermal head 15 abuts against the lower surface of the stencil plate 50A or 50C. Through the clockwise rotation of the head holder 16, the roller holder 19 is rotated counterclockwise, and the pin 22 is slidably contacted with the side end surface 25A of the paper gate 25 to rotate the paper gate 25 clockwise around the shaft 26. Through this operation, the paper gate 25 is rotated clockwise, and the stencil plate 50A or 50C is perforated to form the perforation image displayed on the display 3 while the stencil plate 50A or 50C is fed to the left by rotation of the feeding rollers 13A, 13B, as shown in FIG. 4.

During the plate making process, if RAM 34 stores data indicating that the stencil plate 50C (having no through hole H) is inserted in the plate making device 1, the controller 32 supplies the thermal head 15 with a current for T2 seconds to control a heating time to be relatively long because the non-woven cloth 56C in this stencil plate 50C is impregnated with low-dryness ink and requires large perforation energy in the plate making process. As a result, the heat amount is increased, and the perforation energy is increased so that the heat sensitive stencil paper 54C of the stencil plate 50C can be suitably perforated.

On the other hand, if RAM 34 stores data indicating that the stencil plate 50A (having the through hole H) is inserted in the plate making device 1, the stencil plate 50A is impregnated with high dryness ink, and thus small perforation energy is sufficient in the plate making process. Therefore, the controller 32 supplies the thermal head 15 with a current for T1 seconds, which is shorter than T2 seconds, to control the heat time to be shorter. As a result, the heat amount of the thermal head 15 is reduced, and the perforation energy is reduced, so that the formed holes are prevented from being excessively large.

As described above, the controller 32 detects the type of stencil plate 50 inserted into the plate making device 1 using the light sensor 31, and controls the heat time of the thermal head 15 to perform the optimum plate making process. Therefore, when any kind of stencil plate 50 is inserted, the optimum plate making process can be performed and excellent perforation can be achieved.

The perforated stencil plate 50A or 50C is fed through the discharge roller 23 to the stamp groove 7 as indicated by a two-dotted chain line in FIG. 3. By pushing down the stamp member 60 in this state, the stencil plate 50A or 50C is adhesively bonded by the adhesive layer 63 of the stamp member 60, and the operator removes the stamp member 60 from the stamp groove 7. Through this operation, the print sheet 70 (see FIG. 11) can be printed using the finished stamp member 60.

This invention is not limited to the above embodiment, and various modifications may be made without departing from the scope of this invention.

In the embodiment as described above, two kinds of stencil plates 50 are identified on the basis of the presence or absence of the through hole H. It may be adopted that the number of kinds of through holes H is increased, and the number of the through holes H or the presence or absence of the through holes H is detected by plural light sensors to identify two or more kinds of stencil plates 50.

Further, one of two kinds of current supply times to the thermal head 15 is selected in accordance with the identification result. However, there may be three or more kinds of current supply times set in accordance with the number of types of stencil plates 50, and the optimum time is selected from these set times.

As a method of altering the perforation energy of the thermal head 15, in the above embodiment, the heat time of the thermal head 15, that is, the current supply time is altered. However, the perforation energy may also be altered by altering a voltage to be applied to the thermal head 15.

Figure 8:
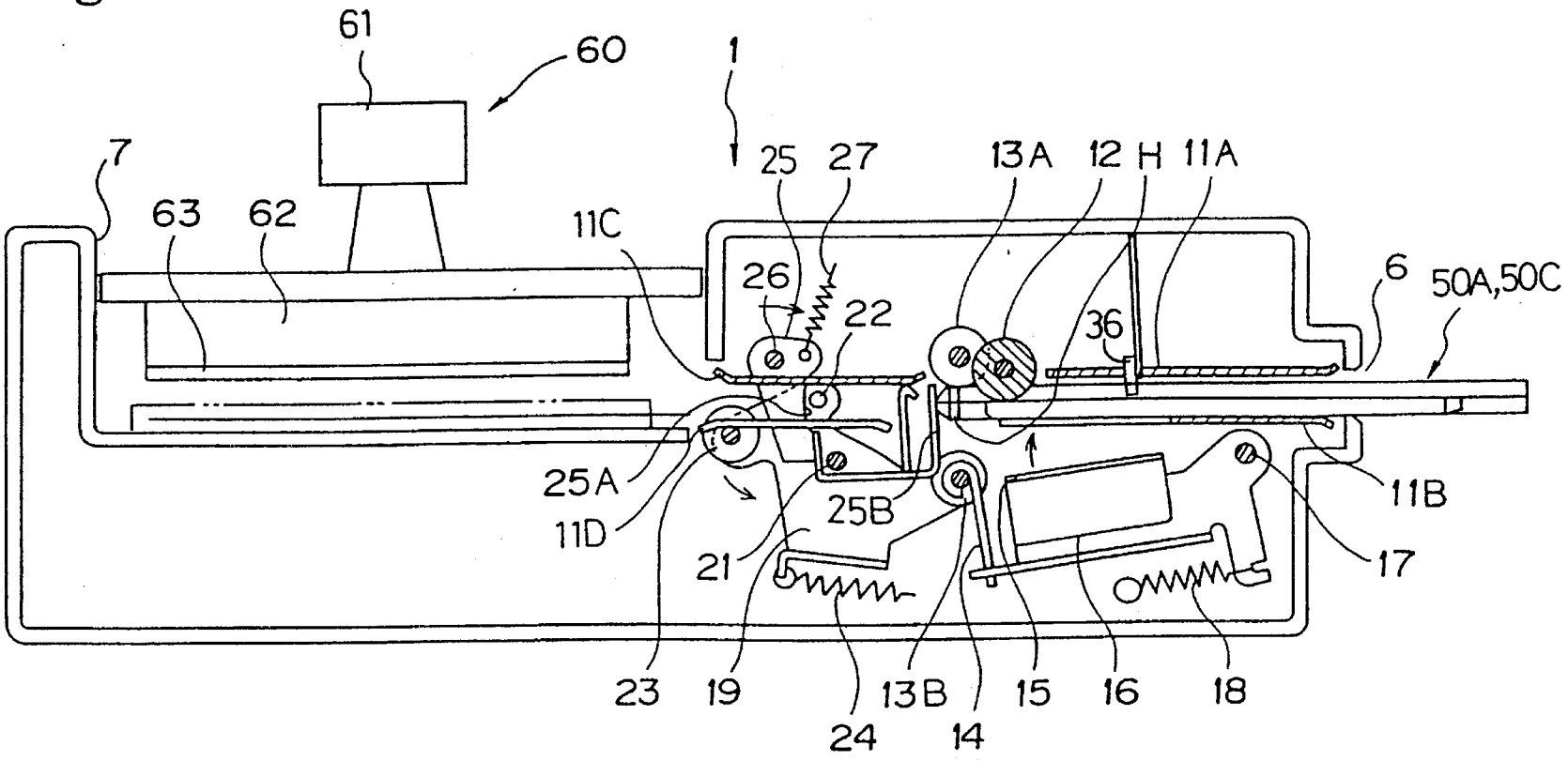
FIG. 8 is a cross-sectional view of the plate making device of another example.
Figure 9A:
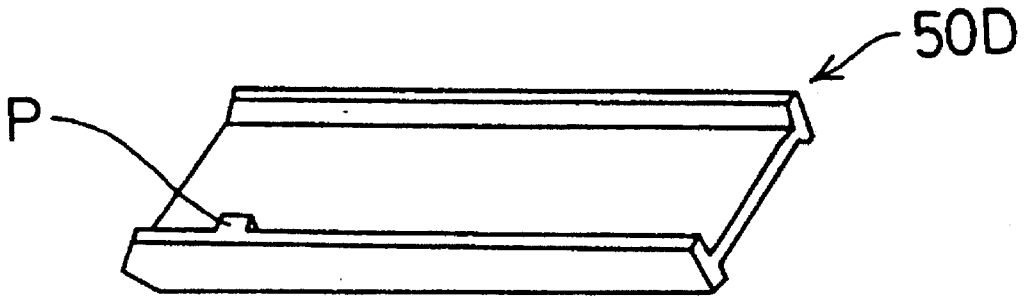
FIG. 9A is a perspective view of a stencil plate of another example.
Figure 9B:
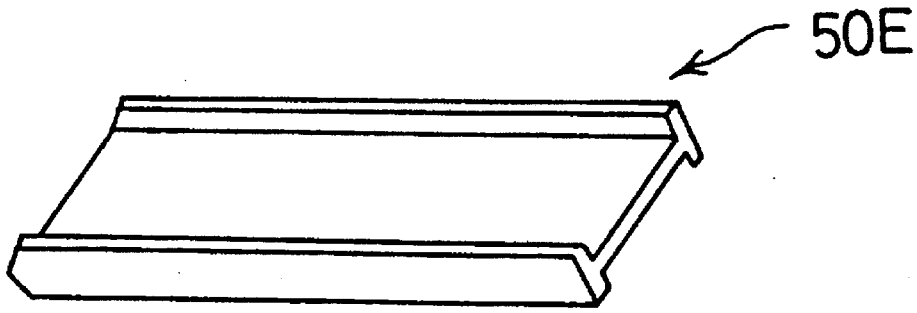
FIG. 9B is a perspective view of a stencil plate of another example.

Further, as a method of identifying the type of stencil plate 50, in the above embodiment, the through hole H formed in the stencil plate 50 and the light sensor provided to the plate making device 1 are used. However, a notch may be formed in the stencil plate in place of the through hole H, which is detected by the light sensor 31. Still further, in place of the light sensor 31, a mechanical type switch 36 (FIGS. 7B and 8) may be provided so as to be switched on/off in accordance with the presence or absence of projection P as shown in FIG. 9A to thereby identify the stencil plate 50D. If the stencil plate 50D is inserted in the insertion window 6, the switch 36 is switched on by the projection P, and it is identified as the stencil plate 50D. On the other hand, if a stencil plate 50E without the projection P is inserted in the insertion window 6, the switch 36 is off, and it is identified as the stencil plate 50E.

What is claimed is:

1. A plate making device, comprising:

a stencil plate, the stencil plate being one of at least two types, each type having a unique identifying feature and comprising an ink impermeable layer, a frame, a non-woven cloth impregnated with ink, and a heat sensitive stencil paper;

heat-perforating means for thermally perforating the heat sensitive stencil paper of the stencil plate according to a desired image;

detecting means for detecting the type of the stencil plate based on the unique identifying feature; and controlling means for controlling perforation energy of said heat-perforating means in accordance with the detected type of the stencil plate.

2. The plate making device according to claim 1, wherein said detecting means discriminates which of the at least two types of stencil plate is present in accordance with the unique identifying feature comprising at least one of an existence and number of apertures in the stencil plate.

3. The plate making device according to claim 1, wherein the frame surrounds the non-woven cloth, and the ink impermeable layer and the heat sensitive stencil paper sandwich the non-woven cloth and the frame therebetween.

4. The plate making device according to claim 3, wherein the heat sensitive stencil paper is formed of a film of material selected from the group consisting of polyethylene terephthalate, polypropylene, and vinylidene chloride-vinyl chloride copolymer having a thickness of about 1–4 μm.

5. The plate making device according to claim 1, further comprising:

a first shaft fixed to the plate making device;

a second shaft;

a third shaft;

a heat-perforating means holder supporting said heat-perforating means, said heat-perforating means holder being rotatable about said first shaft;

a spring fixed to said heat-perforating means holder and urging said heat-perforating means holder toward a heat-perforating means engagement position;

a feeding roller movable with rotation of said heat-perforating means holder, said feeding roller fixed to a roller holder, said roller holder being rotatable about said second shaft and comprising a pin; and a paper gate rotatably supported by said third shaft, said pin engaging said paper gate, said heat-perforating means holder engaging said roller holder such that rotation of said heat-perforating means holder causes said roller holder to rotate in synchronism with said heat-perforating means holder, and wherein said pin urges said paper gate to clear a feeding path for the stencil plate.

6. The plate making device according to claim 1, wherein said detecting means comprises a light sensor having a light irradiating unit and a light receiving unit.

7. The plate making device according to claim 6, wherein said controlling means comprises a CPU operatively coupled with said light sensor, said CPU controlling the perforation energy in accordance with a signal from the light sensor.

8. A plate making device according to claim 1, wherein said detecting means comprises a switch movable between at least a first position and a second position in accordance with the presence of the unique identifying feature comprising a projection on said stencil plate.

9. The plate making device according to claim 1, wherein the type of the stencil plate is differentiated by a kind of the ink impregnating the non-woven cloth.

10. The plate making device according to claim 9, wherein the at least two types of stencil plate comprise a low-dryness ink stencil plate and a high-dryness ink stencil plate, and wherein when said detecting means detects the low-dryness ink stencil plate, said controlling means supplies current to said heat-perforating means for a first predetermined time, and when said detecting means detects the high-dryness ink stencil plate, said controlling means supplies current to said heat-perforating means for a second predetermined time shorter than the first predetermined time.

11. The plate making device according to claim 9, wherein the at least two types of stencil plate comprise a low-viscosity ink stencil plate and high-viscosity ink stencil plate, and when the detecting means detects the low-viscosity ink stencil plate, the controlling means supplies current to the heat-perforating means for a first predetermined time, and when the detecting means detects the high-viscosity ink stencil plate, the controlling means supplies current to the heat-perforating means for a second predetermined time longer than the first predetermined time.

12. A plate making device, comprising:

a stencil plate, the stencil plate being one of at least two types, each type having a unique identifying feature and comprising an ink impermeable layer, a frame, a non-woven cloth impregnated with ink, and a heat sensitive stencil paper;

a thermal head that perforates the heat sensitive stencil paper of the stencil plate according to a desired image;

a detector that detects the type of the stencil plate; and a controller operatively coupled to said detector and said thermal head, said controller controlling operation and perforation energy of said thermal head in accordance with a signal from said detector.

13. The plate making device according to claim 12, wherein the frame surrounds the non-woven cloth, and the ink impermeable layer and the heat sensitive stencil paper sandwich the non-woven cloth and the frame therebetween.

14. The plate making device according to claim 13, wherein the heat sensitive stencil paper is formed of a film of material selected from the group consisting of polyethylene terephthalate, polypropylene, and vinylidene chloride-vinyl chloride copolymer having a thickness of about 1–4 μm.

15. The plate making device according to claim 12, further comprising:

a first shaft fixed to the plate making device;

a second shaft;

a third shaft;

a head holder supporting said thermal head, said head holder being rotatable about said first shaft;

a spring fixed to said head holder and urging said head holder toward a thermal head engagement position;

a feeding roller movable with rotation of said head holder, said feeding roller fixed to a roller holder, said roller holder being rotatable about said second shaft and comprising a pin; and a paper gate rotatably supported by said third shaft, said pin engaging said paper gate, said head holder engaging said roller holder such that rotation of said head holder causes said roller holder to rotate in synchronism with said head holder, and wherein said pin urges said paper gate to clear a feeding path for the stencil plate.

16. The plate making device according to claim 12, wherein said detector comprises a light sensor having a light irradiating unit and a light receiving unit.

17. The plate making device according to claim 16, wherein said controller comprises a CPU operatively coupled with said light sensor, said CPU controlling said perforation energy in accordance with the signal from said light sensor.

18. The plate making device according to claim 10, wherein said detector discriminates between the at least two types of stencil plate in accordance with the unique identifying feature comprising at least one of an existence and number of apertures in the stencil plate.

19. A plate making device according to claim 12, wherein said detector comprises a switch movable between at least a first position and a second position in accordance with the presence of the unique identifying feature comprising a projection on said stencil plate.

20. The plate making device according to claim 12, wherein the type of the stencil plate is differentiated by a kind of the ink impregnating the non-woven cloth.

21. The plate making device according to claim 20, wherein the at least two types of stencil plate comprise a low-dryness ink stencil plate and a high-dryness ink stencil plate, and wherein when said detector detects the low-dryness ink stencil plate, said controller supplies current to said thermal head for a first predetermined time, and when said detector detects the high-dryness ink stencil plate, said controller supplies current to said thermal head for a second predetermined time shorter than said first predetermined time.

22. The plate making device according to claim 29, wherein the at least two types of stencil plate comprise a low-viscosity ink stencil plate and high-viscosity ink stencil plate, and when the detector detects the low-viscosity ink stencil plate, the controller supplies current to the heat-perforating means for a first predetermined time, and when if the detector detects the high-viscosity ink stencil plate, the controller supplies current to the heat-perforating means for a second predetermined time longer than the first predetermined time.

23. A method of forming a stencil plate having a heat sensitive stencil paper for a stamp device, the method comprising:

thermally perforating the heat sensitive stencil paper of the stencil plate according to a desired image;

detecting a type of the stencil plate; and controlling perforation energy in said thermal perforating step in accordance with the type of the stencil plate.

24. The method according to claim 23, wherein the type of the stencil plate comprises at least two types of stencil plate, said detecting step comprising discriminating which one of the at least two types of stencil plate is present in accordance with at least one of an existence and number of apertures in the stencil plate.

25. The method according to claim 23, wherein said detecting step comprises detecting light with a light sensor having a light irradiating unit and a light receiving unit.

26. The method according to claim 25, wherein said controlling step comprises controlling the perforation energy in accordance with a signal from said light sensor.

27. The method according to claim 23, wherein the type of the stencil plate comprises at least two types of stencil plate comprising a low-dryness ink stencil plate and a high-dryness ink stencil plate, and wherein when said detecting step detects the low-dryness ink stencil plate, said controlling step comprises supplying current in said thermal perforating step for a first predetermined time, and when said detecting step detects the high-dryness ink stencil plate, said controlling step comprises supplying current in said heat-perforating step for a second predetermined time shorter than the first predetermined time.

28. The method according to claim 23, wherein the type of the stencil plate is one of at least two types of the stencil plate, the at least two types of stencil plate comprise a low-viscosity ink stencil plate and high-viscosity ink stencil plate, and when the detecting step detects the low-viscosity ink stencil plate, the controlled perforation energy is supplied for a first predetermined time, and when the detecting step detects the high-viscosity ink stencil plate, the controlled perforation energy is supplied for a second predetermined time longer than the first predetermined time.

29. A plate making device, comprising:

a stencil plate, the stencil plate being one of at least two types, each type having a unique identifying feature and comprising an ink impermeable layer, a frame, a non-woven cloth impregnated with ink and a heat sensitive stencil paper;

heat-perforating means for thermally perforating the heat sensitive stencil paper of the stencil plate according to a desired image;

signal providing means for providing a signal representing the type of the stencil plate; and controlling means for controlling perforation energy of said heat-perforating means in accordance with the type of the stencil plate.

30. The plate making device according to claim 29, wherein the at least two types of stencil plate comprise a low-dryness ink stencil plate and a high-dryness ink stencil plate, wherein when said signal providing means provides a signal representing the low-dryness ink stencil plate, said controlling means supplies current to said heat-perforating means for a first predetermined time, and when said signal providing means provides a signal representing the high-dryness ink stencil plate, said controlling means supplies current to said heat-perforating means for a second predetermined time shorter than the first predetermined time.

31. The plate making device according to claim 29, wherein the non-woven cloth impregnated with ink is disposed at a central portion of the frame and supported between the ink impermeable layer and the heat sensitive stencil paper.

32. The plate making device according to claim 31, wherein the type of the stencil plate is differentiated by a kind of the ink impregnating the non-woven cloth.

33. The plate making device according to claim 29, wherein the at least two types of stencil plate comprise a low-viscosity ink stencil plate and high-viscosity ink stencil plate, and said signal providing means further comprises detecting means for detecting the type of the stencil plate, when the detecting means detects the low-viscosity ink stencil plate, the controlling means supplies current to the heat-perforating means for a first predetermined time, and when the detecting means detects the high-viscosity ink stencil plate, the controlling means supplies current to the heat-perforating means for a second predetermined time longer than the first predetermined time.

* * * * *